US005318352A

United States Patent [19]

Holland

[11] Patent Number: 5,318,352

[45] Date of Patent: Jun. 7, 1994

[54] METHOD OF MAKING A TOOTHBRUSH

[75] Inventor: Neta Holland, Nes Ziona, Israel

[73] Assignee: Oraline International B.V., Amsterdam, Netherlands

[21] Appl. No.: 981,654

[22] Filed: Nov. 25, 1992

Related U.S. Application Data

[63] Continuation-in-part of Ser. No. 627,098, Dec. 13, 1990, Pat. No. 5,184,368.

[30] Foreign Application Priority Data

Nov. 20, 1990 [IL] Israel ..... 96413
Mar. 19, 1992 [IL] Israel ..... 101295

[51] Int. Cl.[5] ..... A46D 3/06
[52] U.S. Cl. ..... 300/21
[58] Field of Search ..... 300/21; 15/167.1, 201, 15/191; 132/308

[56] References Cited

U.S. PATENT DOCUMENTS

| | | | |
|---|---|---|---|
| 1,086,509 | 2/1914 | Chandler | 300/21 |
| 1,238,635 | 8/1917 | Chandler et al. | 300/21 |
| 1,601,217 | 9/1926 | Jones | 300/21 X |
| 2,017,845 | 10/1935 | Alexander | 300/21 |
| 2,122,318 | 6/1938 | Jobst | 300/21 |
| 2,542,709 | 2/1951 | Rowland | 300/21 X |
| 2,616,763 | 11/1952 | Vose et al. | 300/21 |
| 3,255,479 | 6/1966 | Dolan et al. | 300/21 X |
| 3,375,041 | 3/1968 | Tamny | 300/21 |
| 3,839,763 | 10/1974 | Gould | 300/21 X |
| 5,061,106 | 10/1991 | Kent | 300/21 X |

FOREIGN PATENT DOCUMENTS

| | | | |
|---|---|---|---|
| 439274 | 9/1948 | Italy | 300/21 |
| 6389 | 12/1921 | Netherlands | 300/21 |
| 869968 | 6/1961 | United Kingdom | 300/21 |

*Primary Examiner*—Mark Rosenbaum
*Assistant Examiner*—Frances Chin
*Attorney, Agent, or Firm*—Benjamin J. Barish

[57] ABSTRACT

A spring member includes a planar strip of elastic material formed with a plurality of spirally-extending slits at spaced locations to define a plurality of spirally-extending elements integrally formed with the strip. The spirally-extending elements are pressed out of the plane of the strip to produce a plurality of helically-extending springs integrally formed with the strip, each spring decreasing in diameter from the strip to the outer end of the spring. Also described is the use of such spring members in toothbrushes and keyboards. Further described are methods of making such a spring member and making brush heads including such spring members.

5 Claims, 3 Drawing Sheets

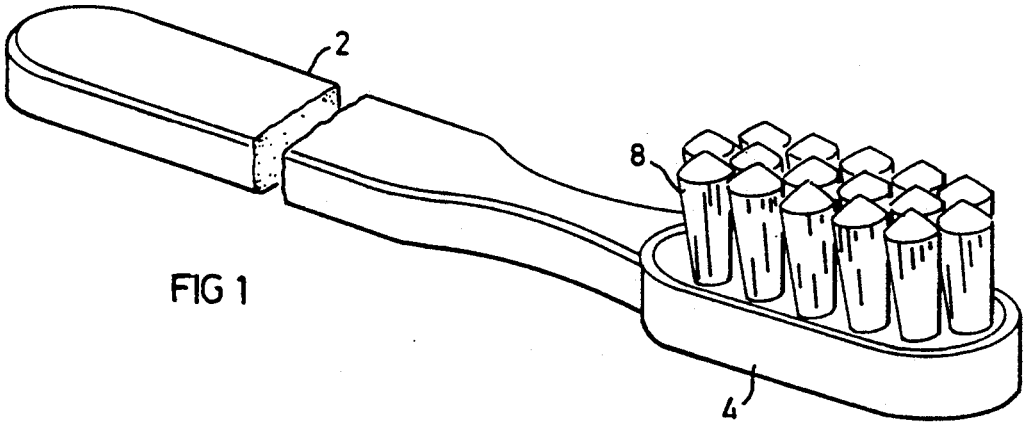
FIG 1
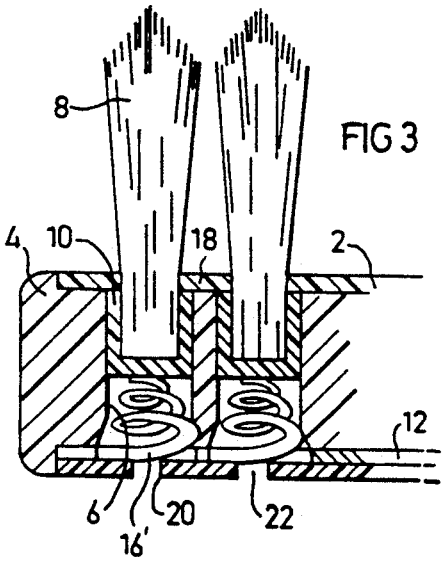
FIG 3
FIG 2
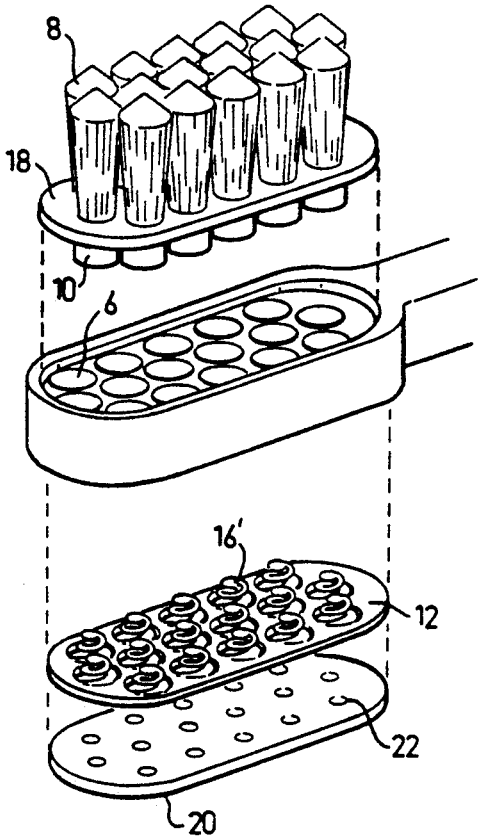
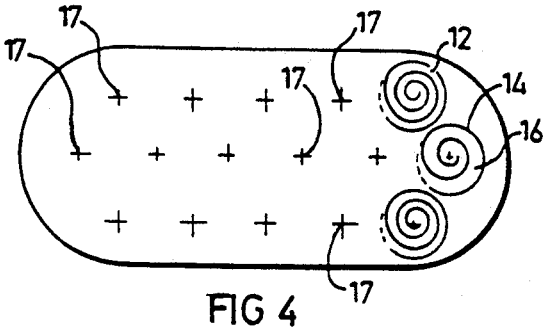
FIG 4

METHOD OF MAKING A TOOTHBRUSH

RELATED APPLICATION

The present application is a continuation-in-part of my prior U.S. Pat. application Ser. No.07/627,098 filed Dec. 13, 1990, now U.S. Pat. No. 5,184,368.

FIELD AND BACKGROUND OF THE INVENTION

Patent application Ser. No. 07/627,098 discloses toothbrushes having spring-mounted bristle holders. One embodiment described in that patent application includes a spring member in the form of a planar strip of elastic material integrally formed with a plurality of helically-extending springs underlying the bristle holders and effective to urge the bristle holders outwardly but to permit their inward movement during use of the brush.

The present application is directed to the spring member per se, since such a member is also capable of use in other applications, e.g., keyboards and the like. The present application also relates to the method of making such a spring member, to a method of making brush heads including such spring members, and to a keyboard including such a spring member.

BRIEF SUMMARY OF THE INVENTION

According to the invention in the present application, there is provided a method of making a brush comprising: loading a plurality of cups, each having an open end, into a plurality of sockets formed in a rigid base member; placing a plurality of groups of bristles across the open end of each of the cups with an intermediate line of each group of bristles substantially aligned with a diametrical line of the cup; applying an anchor bar across the intermediate line of each group of bristles and driving the anchor bar into the respective cup to cause the group of bristles to fold at the intermediate line and to bring together the ends of the bristles on opposite sides of the intermediate line, the length of each of the anchor bars being slightly larger than the inner diameter of the respective cup to cause the anchor bar to become firmly wedged in the cup and thereby to firmly anchor the bristles therein; removing the cups and the bristles anchored therein from the rigid base member; and mounting the cups and the bristles anchored therein in a brush head.

According to further features in the described preferred embodiment, a plate formed with a plurality of holes, one for each of the cups, is placed over the cups with each hole aligned with its respective cup before the anchor bar drives the bristles into the cups, such that the anchor bar drives each group of bristles into its respective cup through its respective hole in the plate, whereby all the cups are secured by their bristles to the plate. The cups and bristles are removed with the plate as a unit from the base member and are mounted in the brush head.

According to further features in the described preferred embodiment, the brush head is formed with a plurality of sockets each opened at one side of the brush head for slidably receiving the cups, the method further including applying, to the one side of the brush head, a planar strip of elastic material integrally formed with a spring element for, and engageable with, each of the cups for urging the bristles of the cups outwardly through the opposite side of the brush head. The cups then serve as spring-biassed bristle holders in the toothbrush.

According to a still further aspect of the invention, there is provided a keyboard including a spring member as described above, and a plurality of depressible keys each aligned with one of the helically-extending springs.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensionals view illustrating one form of toothbrush constructed in accordance with the present invention;

FIG. 2 is an exploded view more particularly illustrating the construction of the brush head of FIG. 1;

FIG. 3 is a fragmentary sectional view illustrating the brush head in the toothbrush of FIG. 1;

FIG. 4 is a top plan view illustrating the spring member included in the toothbrush of FIGS. 1–3 in the flat condition of the spring member;

DESCRIPTION OF PREFERRED EMBODIMENTS

Figure 5:
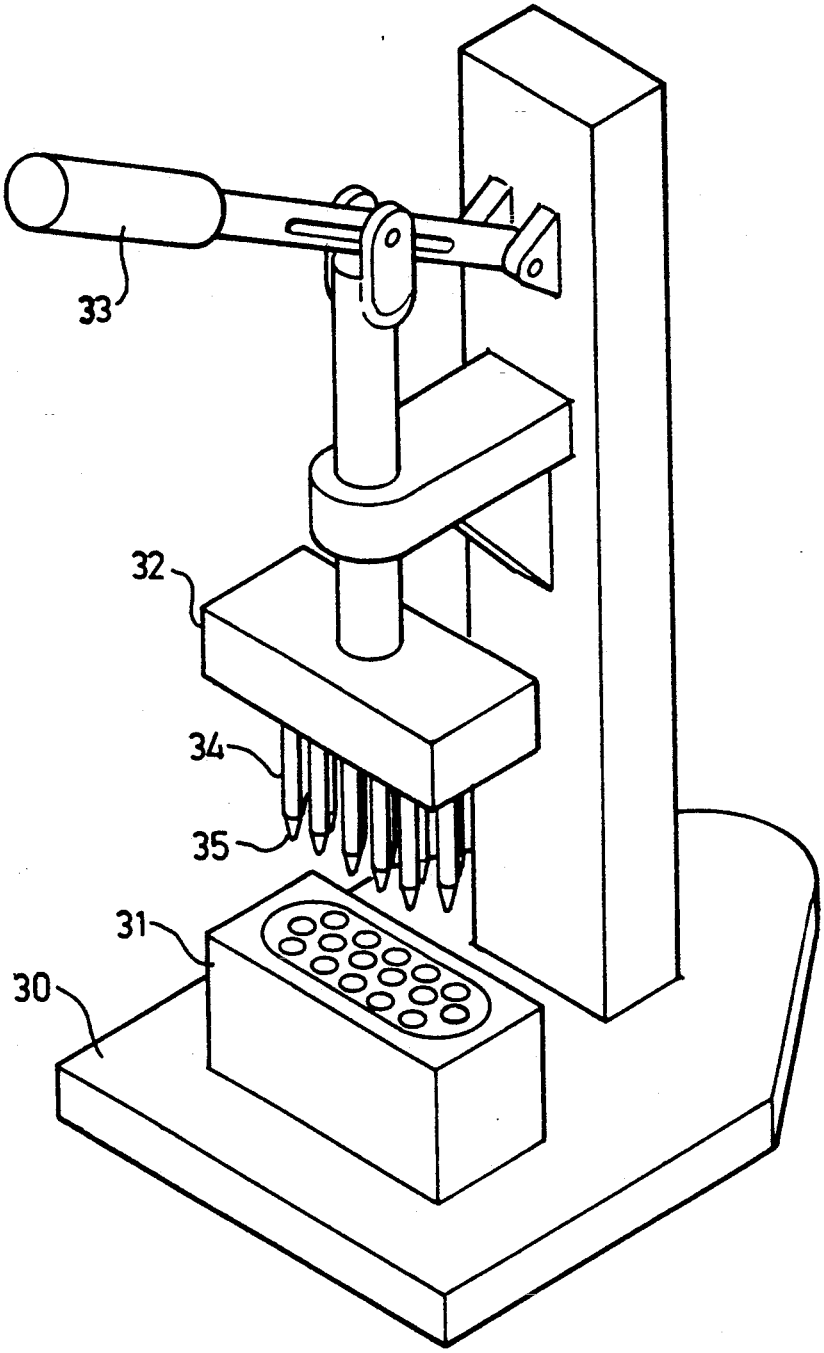
FIG. 5 illustrates a device which may be used for pressing the spirally-extending elements formed in the planar strip of elastic material out of the plane of that strip to produce the spring member integrally formed with a plurality of helically-extending springs.

FIGS. 1–3 illustrate a toothbrush constructed as described in my patent application Ser. No. 07/627,098. The toothbrush includes a handle 2 at one end, and a brush head 4 at the opposite end. The brush head 4 is formed with a plurality of sockets 6 each receiving a plurality of bristles 8 mounted within bristle holders in the form of cups 10 slidable within their respective sockets so as to permit the bristle holders to be individually movable either to an extended position (FIG. 3) or to a retracted position within their respective sockets.

The toothbrush further includes a spring member 12 cooperable with all the bristle holders 10 and urging them outwardly to their extended positions in order to press the bristles against the surfaces being brushed. By thus spring-mounting the bristle holders for individual movement, the bristles more effectively penetrate into all the crevices of the teeth and between the teeth, thereby producing an efficient brushing action. In addition, when the bristle holders are pressed inwardly during brushing, the bristles are stiffened because of the decrease in their effective lengths, thereby further enhancing the brushing action.

As shown in FIGS. 2–4, the spring member 12 for the bristle holders 10 is a planar strip of elastic material, preferably stainless steel, formed with a plurality of spirally-extending slits 14 at spaced locations to underlie each of the bristle holders. The spiral slit 14 thus define a plurality of spirally-extending elements 16, having their centers at 17, integrally formed with the strip 12 and in the same plane as the strip. After the strip is so formed, the spirally-extending elements 16 are pressed out of the plane of the strip, such that they now become helically-extending springs, as shown at 16' in FIGS. 2 and 3, each spring decreasing in diameter from the strip 12 to its outer end in engagement with its bristle holder 10.

The brush head 2 is made of suitable plastic material, as by injection moulding. It is formed with the sockets 6 for slidably receiving the bristle holders 10. One side of the brush head is closed by a cover plate 18 through which the bristles 8 project under the influence of the helical spring elements 16' of the spring member 12. The opposite side of brush head 2 receives the spring member 2 and is closed by a cover plate 20 formed with a plurality of drain openings 22, one for, and aligned with, each of the sockets 6.

The spiral slits 14 defining the plurality of spirally-extending elements 16 may be formed by a simple stamping operation. Preferably, however, they are formed by etching as well known in printed-circuit technology. A preferred method would be to apply an etch-resistant coating, via a silk-screen mask, to a thin sheet of stainless steel, such that the complete surface of the sheet is covered by the etch-resistant material except for the exposed lines defining the spirally-extending slits 14, and then to apply an etching material to the sheet in order to etch away the exposed lines of the sheet, thereby to produce the spirally-extending slits 14. After the slits have thus been produced, the etch-resistant material is removed.

FIG. 4 illustrates an additional feature in the construction of the spring member 12. In the illustration of FIG. 4, the spring member 12 is formed with three rows of spirally-extending slits 14. It will be seen, however, that the spirally-extending slits 14 in the two outer rows are narrower in width, and also have more turns, than those in the intermediate row. Thus, when the spring member is used in a toothbrush as described above, the bristle holders 10 engaged by the helically-extending spring elements 16' in the two outer rows will be softer in their springiness than the intermediate row of bristle holders engaged by the intermediate row of helically-extending springs.

FIG. 5 illustrates a press that may be used for pressing the spirally-extending elements 16 out of the plane of the spring member 12 to produce the helically-extending springs 16'. The press includes a base 30 supporting a work holder 31 receiving the spring member 12 (FIG. 4). A presser member 32 is mounted over the work holder 31 so as to be movable towards it by depressing a lever arm 33. Presser member 32 carries a presser element 34 for, and aligned with, each of the spirally-extending elements 16 formed in the spring member 12. The outer tip of each presser member 32 is of conical formation, as shown at 35, and is aligned with the center point 17 (FIG. 4) of each element 16.

Thus, depression of handle 33 lowers all the presser elements 34 to bring their conical tips 35 into engagement with the center point 17 of each of the spirally-extending elements 16 in the spring member 12, and presses those elements outwardly of the plane of the spring member to form the helically-extending springs 16'.

Figure 6:
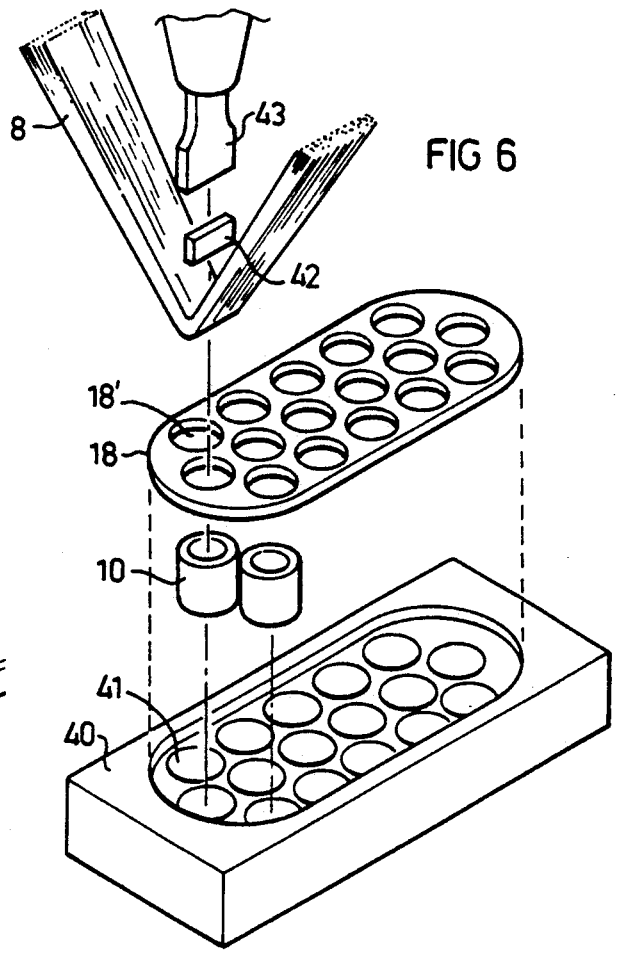
FIG. 6 illustrates the manner of anchoring the bristles of the toothbrush in the bristle holders which are spring-mounted in the brush head.

FIG. 6 illustrates how the bristles 8 are secured within the bristle holders 10.

Figure 7:
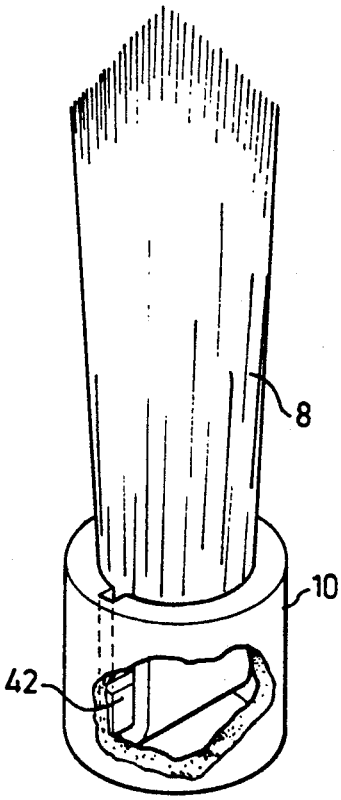
FIG. 7 illustrates one of the bristle-holder cups, with the bristles anchored therein, produced by the method illustrated in FIG. 6.

Thus, a rigid, metal base member 40 is prepared with a plurality of sockets 41 each to receive a plastic cup which eventually serves as the bristle holder 10. A group of bristles 8 are placed over the open end of each of the cups 10 with an intermediate line, preferably the center line, of each group of bristles substantially aligned with a diametrical line of the respective cup 10. An anchor bar 42 is applied across the intermediate line of each group of bristles and is driven by an actuator 43 into the respective cup to cause the group of bristles to fold at the intermediate line and to bring together the ends of the bristles on opposite sides of the intermediate line. Thus, when anchor bar 42 has been fully inserted into its respective cup 10, the respective group of bristles has been folded so as to extend substantially parallel to each other outwardly of the open end of the cup, as shown in FIG. 7.

Each anchor bar 42 is of a length slightly larger than the inner diameter of its respective cup 10. Thus, when the anchor bar 42 is driven inwardly of the cup by actuator 43, the anchor bar becomes firmly wedged in the inner surface of the cup, to thereby firmly anchor the bristles within the cup.

Before the anchor bars 42 are driven, with the bristles 8, into their respective cups 10, the cover plate 18 is introduced between the cups and the bristles, as shown in FIG. 6. Cover plate 18 is of plastic and has an opening 18' for each of the cups 10. The cover plate is placed over the cups with each hole aligned with its respective cup. The anchor bars 42 are driven sequentially by actuator 43 through the holes 18' in cover plate 18 into their respective cups 10. The arrangement is such that after all the anchor bars have thus been driven into the cups 10, the cover plate 18 carries all the cups 10 via their respective bristles 8, as shown in FIG. 2.

The cover plate 18, together with all the cups 10 and their bristles 8, may then be removed as a unit from the base member 40 and applied to close one side of the brush head 4. The spring member 12 is applied across the opposite side of the brush head, and that side is closed by plastic cover plate 20 formed with the drain openings 22 aligned with the sockets 6. The two cover plates 18 and 20 are then bonded by heat to the brush head.

The foregoing method of making the toothbrushes is to be distinguished from a known method of making toothbrushes also utilizing anchor bars for anchoring the bristles in the brush head. Thus, in this known method of making toothbrushes, the anchor bars are driven directly into sockets formed in the brush head. In the above-described method, however, the anchor bars are driven from one side of cover plate 18, through openings in the cover plate, into cups 10 on the opposite side of the cover plate. The outer diameters of the cups 10 are larger than the diameters of the openings 18' in the cover plate 18, so that all the cups become attached to the cover plate 18 by the bristles 8 and permit the cover plate to be removed as a unit from the rigid base member 40 and applied to the brush head. The cups 10 then become the bristle holders in the brush head which are displaceable by the spirally-extending spring elements 16' formed in the spring member 12.

As one example, the cups 10 may have a very small wall thickness, less than 0.3 mm, e.g., about 0.25 mm. However, despite this wall thickness, the perfect round shape of the cups is retained by the rigid, metal base member 40 in which the cups are disposed at the time the anchor bars 42 are driven into the cups.

Figure 8:
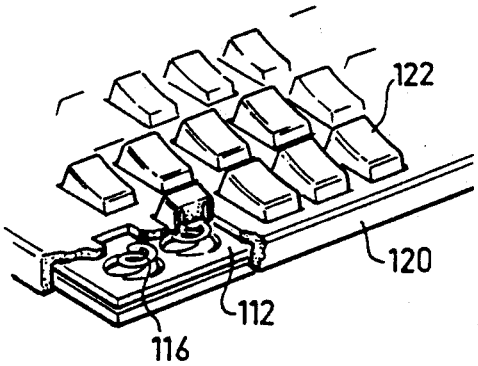
FIG. 8 illustrates a keyboard including a spring member constructed as described above.

FIG. 8 illustrates another application of the spring member, therein designated 112, integrally formed with a plurality of the spirally-extending springs 116. Thus, as shown in FIG. 8, such a spring member may also be used in a keyboard 120 having a plurality of depressible keys 122 each aligned with one of the springs 116, and adaptable to actuate an operator 130 of a switch 132.

While the invention has been described with respect to two preferred embodiments, it will be appreciated that many other variations, modifications and applications of the invention may be made.

What is claimed is:

1. A method of making a brush, comprising: loading a plurality of cups, each having an open end, into a plurality of sockets formed in a rigid base member; placing a plurality of groups of bristles across the open end of each of said cups with an intermediate line of each group of bristles substantially aligned with a diametrical line of the cup; applying an anchor bar across said intermediate line of each group of bristles and driving said anchor bar into the respective cup to cause the group of bristles to fold at said intermediate line and to bring together the ends of the bristles on opposite sides of said intermediate line, the length of each of said anchor bars being slightly larger than the inner diameter of the respective cup to cause the anchor bar to become firmly wedged in the cup and thereby to firmly anchor the bristles therein; removing said cups and the bristles anchored therein from said rigid base member; mounting said cups and the bristles anchored therein in a brush head formed with a plurality of sockets each opened at one side of the brush head for slidably receiving the cups; and applying, to said one side of the brush head, a planar strip of elastic material integrally formed with a spring element for, and engageable with, each of said cups for urging the bristles of the cups outwardly through the opposite side of the brush head.

2. The method according to claim 1, wherein said spring elements are helically-extending elements integrally formed with said planar strip of elastic material.

3. The method according to claim 1, wherein a plastic cover is applied over said planar strip and is bonded to said one side of the brush head; said plastic cover being performed with a plurality of drain openings, one for, and aligned with, each of said sockets in the brush head.

4. A method of making a brush, comprising: loading a plurality of cups, each having an open end, into a plurality of sockets formed in a rigid base member; placing a plurality of groups of bristles across the open end of each of said cups with an intermediate line of each group of bristles substantially aligned with a diametrical line of the cup; applying an anchor bar across said intermediate line of each group of bristles and driving said anchor bar into the respective cup to cause the group of bristles to fold at said intermediate line and to bring together the ends of the bristles on opposite sides of said intermediate line, the length of each of said anchor bars being slightly larger than the inner diameter of the respective cup to cause the anchor bar to become firmly wedged in the cup and thereby to firmly anchor the bristles therein; removing said cups and the bristles anchored therein from said rigid base member; and mounting said cups and the bristles anchored therein in a brush head; wherein a plate formed with a plurality of holes, one for each of said cups, is placed over the cups with each hole aligned with its respective cup before the anchor bar drives the bristles into the cups, such that the anchor bar drives each group of bristles into its respective cup through its respective hole in the plate, whereby all the cups are secured by their bristles to said plate; and wherein the cups and bristles are removed with said plate as a unit from said base member and are mounted in said brush head.

5. The method according to claim 4, wherein the brush head is formed with a plurality of sockets each opened at one side of the brush head for slidably receiving the cups, said method further including applying, to said one side of the brush head, a planar strip of elastic material integrally formed with a spring element for, and engageable with, each of said cups for urging the bristles of the cups outwardly through the opposite side of the brush head.

* * * * *